United States Patent [19]

Swiatosz

[11] Patent Number: 4,966,139

[45] Date of Patent: Oct. 30, 1990

[54] OXYGEN BREATHING BAG SIMULATOR

[75] Inventor: Edmund Swiatosz, Maitland, Fla.

[73] Assignee: The United States of America as represented by the Secretary of the Navy, Washington, D.C.

[21] Appl. No.: 374,110

[22] Filed: Jun. 23, 1989

[51] Int. Cl.[5] ..... A62B 7/00

[52] U.S. Cl. ..... 128/205.23; 128/205.24; 128/204.28

[58] Field of Search ..... 128/204.26, 204.28, 128/205.12, 205.13, 205.14, 205.16, 205.24, 202.26

[56] References Cited

U.S. PATENT DOCUMENTS

| | | | |
|---|---|---|---|
| 3,457,953 | 7/1969 | Warncke et al. | 128/204.28 |
| 3,794,021 | 2/1974 | Lambertsen | 128/204.28 |
| 4,195,627 | 4/1980 | Haertle | 128/202.26 |
| 4,265,238 | 5/1981 | Swiatosz et al. | 128/205.12 |
| 4,364,384 | 12/1982 | Warncke et al. | 128/204.28 |
| 4,596,246 | 6/1984 | Lyall | 128/202.27 |

OTHER PUBLICATIONS

Oxygen Breathing Apparatus Breathing Bag Simulator/Trainer by Swiatosz et al., Navy Technical Disclosure Bulletin vol. 10, #1, Sep. 1984.

*Primary Examiner*—Edgar S. Burr
*Assistant Examiner*—Aaron J. Lewis
*Attorney, Agent, or Firm*—Robert W. Adams

[57] ABSTRACT

A valve within an oxygen breathing apparatus (OBA) simulator to simulate the loss of oxygen supply that occurs in an operational OBA when the user accidentally deflates the bag(s), such as by impact. The valve is within the tubular conduit inside the simulator's airbag and is held in its open position when the airbag is inflated by a cord attached to the inner surface of the bag, but is spring loaded to close and block the oxygen path through the conduit when the attachment cord is slackened.

6 Claims, 1 Drawing Sheet

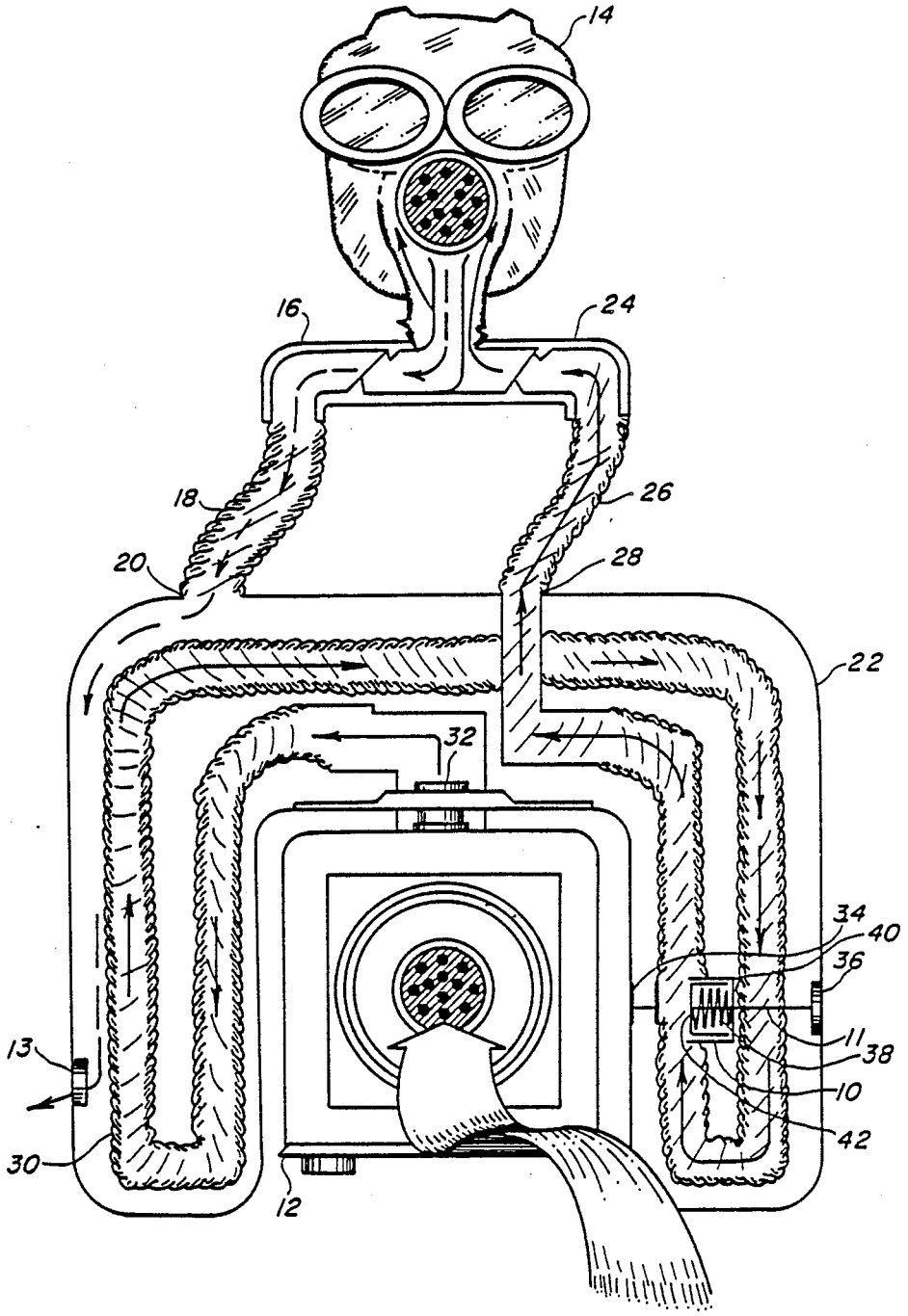
FIGURE

OXYGEN BREATHING BAG SIMULATOR

BACKGROUND OF THE INVENTION

The invention relates to the field of training devices and simulators, and, more specifically, to training in the use and wearing of a supplemental air supply apparatus that involves a face mask and inflatable air bags.

Emergency situations are best handled by personnel skilled in competent procedures that have been acquired through experience and training. The best insurance is good preparation.

Many emergencies require that the responding personnel be provided breathing apparatus to cope with toxic environments. Fires, chemical leaks, explosive atmospheres and underground operations are obvious critical environments where breathing assistance is needed. In such cases the operator must be confident in the apparatus and his own ability to operate it safely and effectively. Otherwise, his attention to the task at hand will suffer in the emergency.

For perfect realism, the apparatus itself would be used in training. But, inasmuch as operational containers of oxygen and oxygen generating devices are used with oxygen breathing apparatuses, cost becomes a significant factor when the operational apparatus is employed for training.

Therefore, simulation is encouraged. Accordingly, the next best thing to the perfect realism of the aparatus itself is the apparatus, slightly modified for training. That is what the present invention provides, with an insignificant loss of realism.

Oxygen breathing apparatuses (OBA's) for the most part are closed loop systems which are not vented except by a relief valve. Other apparatuses have filtering arrangements that often include chemical bags for removing a substantial segment of the irritants from the air. In both cases, an inflatable breathing bag may be used. And, it is to simulators having an inflatable breathing bag that the present invention is directed. The simulators for training on the use of the OBA's is the application for which the present invention was originated; however, the techniques disclosed and claimed have application to simulated filtering apparatuses as well that have inflatable bags.

The prior art includes earlier work by the present inventor, such as the oxygen breathing apparatus breathing bag simulator/trainer that is described in the Navy Technical Disclosure Bulletin, Volume 10, No. 1, of Sept. 1984, wherein a modification kit is disclosed that emulates inflation of the operational OBA bag by redirecting exhaled air into supplemental bags that are removably attached in covering relationship to the back of the operational bags. A filter canister is substituted for the OBA's oxygen generator and repiped directly to the user's facemask to couple outside air through the filter to the user. A relief valve is included in the supplemental bags to vent the exhaled air to the outside and prevent over-pressurization. In the operational OBA's the oxygenated air that is on its way to the user first is used to build pressure in the bags and inflate them, whereas the above-described simulator uses air after it has been exhaled by the user to inflate the bags. Another simulator by the inventor that uses exhaled air to inflate the bags is described in U.S. Pat. No. 4,265,238. Therein an operational OBA is disclosed as prior art and shown to include a flexible tube within each bag that provides a circuitous air path from the oxygen generator through one tube emptying into its bag, and from the first bag to the second bag and into its tube which is coupled at its other end to the user's facemask. The other side of the facemask is coupled to the oxygen generator to complete the closed system and recharge the air that is exhaled by the user. The invention is a modification to the operational OBA that converts it to a simulator, and substitutes a flow-through canister for the oxygen generator and adds a crossover valve near the facemask. The crossover valve reverses the air path within the bags such that exhaled air is used to inflate the bags, whereas inhaled air comes directly through the canister to the facemask. Excess pressure within the bags is vented to the outside by a relief port within the crossover valve.

Simulation has been without some necessary effects, however. One is what results from an accidental deflation of the bags. With the operational equipment, bumping or impact to one or both of the bags can cause the bag to lose its air. When the bag deflates there is no air available to the facemask, and the inexperienced user initially develops a feeling of panic. Heretofore, simulation and training has not provided the trainee with that experience. Inasmuch as the bag is inflated with exhaled air in the simulator, loss of inflation does not remove the source of oxygen from the facemask. The result is a potential for negative training. What has been needed is a modification to the simulator that will temporarily inhibit comfortable breathing when the simulator's breathing bag has been accidentally deflated.

Apparatus that automatically shuts off the supply of gas when pressurization is lost in the system is shown in the prior art by the respirator of U.S. Pat. No. 4,364,384 that uses a combination of mechanical triggers operating in close tolerance to permit the systematic use of a measured amount of oxygen but prevent the unlimited venting of oxygen to the outside when the facemask is removed from the user. The system distinguishes between normal inhalation-exhalation and complete depressurization by first and second levers connected to first and second valves, respectively. The first valve opens when normal inhalation has permitted the bag to be deflated its designed amount and come into contact with the first lever; and, the second valve closes when the bag is deflated beyond the designed amount and comes into contact with the second lever. The latter occurs when the otherwise closed system, is opened by a rupture in the system or removal of the facemask. A similar system, but without the automatic shut-off feature, is shown by U.S. Pat. No. 4,195,627 that has a separate valve for each of its two canisters. The user's exhaled air passes through the oxygen generator canister first until the breathing bag is partially inflated, then simultaneously through both canisters until the bag is substantially inflated, and finally only through the carbon dioxide filter canister to full inflation. The valves are operated by a chain that is connected to the far wall of the bag. As the bag is inflated the chain becomes taut and begins to open the valve from the filter while it begins to close the valve from the generator.

Accordingly, none of the known prior art has provided for a training device that simulates the loss of available air to the user of an oxygen breathing apparatus of the type employed by emergency personnel, such as is caused by the unexpected collapse of at least one of the OBA's air bags.

SUMMARY OF THE INVENTION

An object of the present invention is to simulate to a user of an oxygen breathing apparatus, the affects of a catastrophic loss of air supply where the loss results in deflation of at least one of the apparatus'breathing bags. Another object is to provide the simulation by way of a modification to current training devices that does not degrade existing training. And, another object is to provide the simulation with a simple, reliable and cost effective apparatus.

The present invention comprises an improvement to OBA simulators, and includes a spring loaded valve and a cord. The valve and cord are within one of the simulator's air bags, the valve being within the tubular conduit that is within the bag and the cord extending from the valve to the wall of the bag. When the bag is inflated, the cord is taut and the valve is open. When the bag is deflated, the cord is slackened and the valve is biased to its closed position by its spring. The effect of closure of the valve is to restrict the flow of air in the circulation path. Since the system is a closed system, the user senses the loss of available air to breath. The sensation will continue until the bag again is inflated, the cord is taut and the valve is opened.

BRIEF DESCRIPTION OF THE DRAWINGS

The drawing shows an oxygen breathing apparatus (OBA) simulator using a flow-through canister inlet and continuous conduit air path, modified to include the present invention.

DESCRIPTION OF A PREFERRED EMBODIMENT

The present invention is shown in the figure by valve 10 and cord 11. The valve is depicted graphically and shown to be within the air supply path of an embodiment of an oxygen breathing apparatus (OBA) simulator that herefafter will be described. When valve 10 is in the open position that is shown in the figure, the air supply path is unobstructed and the user can breath normally. When cord 11 is slackened, valve 10 is permitted to close and seal-off the supply of air to the user.

The simulator embodiment shown in the figure includes canister 12 that replaces the detachable oxygen generator of the Type A-3 OBA that is commonly used by the U.S. Navy. Whereas the oxygen generator is part of a closed-flow operational OBA system, canister 12 of the simulator is a flow-through device as shown in the figure. Canister 12 accepts air from outside the system for inhalation, and exhaled air is returned by way of pressure relief valve 13 to the environment outside the system. To the user, the simulator operates and feels like the operational equipment.

The airflow path of the simulator externally appears identical to the airflow path of the operational OBA. Beginning at facepiece 14, exhaled breath (shown by the broken arrows) is directed by inverted T-tube 16 through flexible exhalation conduit 18 to fixture 20 on bags 22. Fresh air (shown by the solid arrows) is directed to facepiece 14 through inhalation side 24 of inverted T-tube 16 and flexible inhalation conduit 26, from fixture 28 on bags 22.

However, internally the simulator embodiment shown in the figure differs in significant respects from the OBA. The inhalation airflow path of the simulator is by continuous conduit 30 within bags 22, whereas in the OBA the conduit comprises open-ended tubes in each of the two bags, one tube coming from the oxygen generator and the other going to the inhalation fixture and the facepiece. In the OBA, oxygenated air fills the bags as it dumps from the first tube and flows to the second tube, whereas in the simulator exhaled air from facepiece 14 is used to inflate bags 22.

The simulator shown in the figure (but excluding the present invention) operates as follows: Canister 12 is installed by the user in collar 32. Initially, bags 22 are deflated. However, conduits 30 have remained open and the user can inhale fresh air passing through canister 12, and conduits 30 and 26, to side 24 of tube 16 and facepiece 14. Exhaled breath exits facepiece 14 through tube 16 and conduit 18 to fixture 20 and bags 22. The exhaled breath accumulates in bags 22, causing them to inflate. When the pressure in bags 22 reaches a predesigned threshold, relief valve 13 opens, allowing excess pressure to be released to the outside environment. Excess pressure also is released through valve 13 that is caused by impact or other outside forces on bags 22. If the user stumbles into an obstruction, for example, and the pressure in the bags increases beyond the threshold predesigned for valve 13, the bags will deflate, at least in part.

Prior to the present invention, the user has been able to inhale outside air entering canister 12 and passing along tubular conduits 30 and 26 to inverted T-tube 16 and facepiece 14, even before bags 22 are inflated, or reinflated in the case of an accidental deflation as described immediately above. Inasmuch as the user of an operational OBA cannot breath until the oxygen generator has built-up a supply of air in the bags and inflated (or reinflated) them, but the user of the simulator described in the above-paragraph can breath before bags 30 are inflated, training on the simulator has not completely duplicated the experience of using an OBA.

Accordingly, there has been a need for the present invention. Valve 10 is fitted into conduit 30 and secured to the wall of bags 22 at point 34. The purpose of this attachment is to provide a reference that will hold valve 10 laterally in place when opposing force is applied at point 36 to a first end of cord 11 by the opposite wall of bag 22. Valve 10 is depicted in its simplest graphic form in the figure as a matter of convenience, although other forms and arrangements of available spring loaded valves may be suitable or preferred. Valve 10 is shown as having spring 38 in abutting relationship at one end to wall 40. The other end of spring 38 is attached to piston 42 which is slideably mounted in the housing of valve 10. Piston 42 is attached to the second end of cord 11, and under its influence is forced to compress spring 38 and permit the passage of air through conduit 30 to facepiece 14 when bags 22 are inflated. Before the bags are inflated or when they have been deflated, cord 11 is slack and piston 42 is biased by spring 38 into the closure position, preventing the passage of air through valve 10 in conduit 30.

The simulator shown in the figure, including the present invention, operates as follows: Canister 12 is installed by the user in collar 32. Initially, bags 22 are deflated. Cord 11 is slack. As exhaled breath passes from facepiece 14 through tube 16 and conduit 18 into bags 22, they begin to inflate. As they do, cord 11 becomes taut, increasingly opening valve 10 to the passage of fresh air from canister 12. Likewise, when the bag having valve 10 within it is deflated at least in part, cord 11 slackens and valve 10 closes or begins to close. If deflation is substantial, valve 10 prevents the flow of air to facepiece 14.

Now, the simulator prevents the user from being able to inhale outside air entering canister 12 and passing along tubular conduits 30 and 26 to inverted T-tube 16 and facepiece 14, until bags 22 are inflated, or reinflated in the case of deflation caused by forces external to the system. Now, training on the simulator completely duplicates the experience of using an OBA.

From the foregoing description, it may readily be seen that the present invention comprises a new, unique, and exceedingly useful modification to OBA simulators which constitutes a considerable improvement over the known prior art. Obviously, many modifications and variations of the present invention are possible in light of the above teachings. It is, therefore, to be understood that within the scope of the appended claims the present invention may be practiced otherwise than as specifically described.

What is claimed is:

1. A simulator for training a trainee in the use of a self-contained operational breathing bag device that has an inflatable bag from which a supply of breathable gas is available to the user, wherein the simulator comprises an inflatable bag apparatus having first and second inlets, and first and second outlets; a continuous tubular conduit inside the bag apparatus that forms an uninterrupted path communicating breathable air from said first inlet to said first outlet; means detachably fixed to said first inlet for providing the only source of air to said conduit; a face piece having an inhalation port connected to said first outlet for coupling the air communicated by said conduit to the trainee; and, a valve within said continuous conduit capable of regulating the flow of air through the conduit; attachment means connecting said valve to said inflatable bag for opening the valve to permit the flow of air in response to inflation of the bag, and for closing the valve to prevent the flow in response to deflation of the bag, such that the temporary deprivation of gas to the user that is caused in the operational device by deflation of its bag, is simulated by the simulator; wherein said face piece includes an exhalation port connected to said second inlet of the bag apparatus such that the trainee's exhalation provides the air to inflate the apparatus, and said second outlet of the apparatus is a relief valve to vent excess pressure from the bag apparatus.

2. The improvement of claim 1 wherein said valve is spring actuable normally to be closed such that when the bag is deflated the spring is in its normal position and the valve is closed, restricting the flow of said gas through said conduit.

3. The improvement of claim 2 wherein said spring is deformable to open said valve such that when the bag is inflated the spring is deformed and the valve is open, permitting the flow of said gas through said conduit.

4. The improvement of claim 3 wherein said spring is coupled to the bag by an attachment means for responding to inflation of the bag, such that the attachment means is actuated when the bag is inflated to deform said spring and open said valve.

5. The improvement of claim 4 wherein said attachment means includes a flexible member fixedly attached at its first longitudinal end to said spring, and fixedly attached at its other longitudinal end to said bag, such that when said bag is fully inflated said member is fully extended to cause said spring to fully open said valve.

6. The improvement of claim 5 wherein said attachment means comprises a cord and said valve is open when said cord is taut between said spring and said bag.

* * * * *